United States Patent [19]

Bell

[11] 4,417,409

[45] Nov. 29, 1983

[54] NEEDLEWORK FRAME FOR HANDWORK

[76] Inventor: Lydia A. Bell, 363 Mayflower Blvd., Columbus, Ohio 43213

[21] Appl. No.: 316,950

[22] Filed: Oct. 30, 1981

[51] Int. Cl.[3] ..... D06C 3/08

[52] U.S. Cl. ..... 38/102.91

[58] Field of Search ..... 38/102.91, 102.3, 102.4, 38/102.1; 289/18.1 RF

[56] References Cited

U.S. PATENT DOCUMENTS

| | | | |
|---|---|---|---|
| 1,857,067 | 5/1932 | Seiler | 289/18.1 X |
| 3,098,280 | 7/1963 | Harris et al. | 38/102.91 X |
| 3,732,638 | 5/1973 | Hanley | 38/102.91 |
| 4,102,065 | 7/1978 | Selden | 38/102.1 |
| 4,189,856 | 2/1980 | Cookson | 38/102.4 |
| 4,255,886 | 3/1981 | Klarman | 38/102.3 |
| 4,275,515 | 6/1981 | Hinson | 289/18.1 RF X |

OTHER PUBLICATIONS

Smyrna's Tables and Frames for Rug-making–"Beautiful Rugs You Make Yourself" (p. 68)–Wool Design, Inc. (1980).

Readicut's Canvarex Rug Holding Device–"Readicut, The Finest Rug Kits in the World"; 50 Old Field Point Road; Greenwich, Ct. 06830 (1981).

Sievers Looms Improved Latchet and Mini Latchet Boards–(mail flyer) Sievers Looms; Jackson Harbor Road; Washington Island, Wis. 54246 (1975).

Quandra Needlepoint Frame, Mail Flyer, Stitch n Knit, Inc., Framingham, Mass.

Wiseman, A., *Rub Tapestries and Wool Mosaic,* Van Nostrand Reinhold Book Co., N.Y., 1969, pp. 38–39.

Latch Hook Frame, Mail Flyer, Mary Maxim, Port Huron, Mich.

*Primary Examiner*—Werner H. Schroeder
*Assistant Examiner*—Andrew M. Falik
*Attorney, Agent, or Firm*—Gerald R. Black

[57] ABSTRACT

A canvas support frame for handiwork stitching crafts such as latch hooking, or needlepoint. The frame can fit either onto the operator's lap or onto a table. A canvas is mounted onto the frame whereby the height and the angle of the material can be adjusted by the operator for comfort and easy use. The frame is lightweight and portable, and when not in use, can be closed for easy storage.

6 Claims, 4 Drawing Figures

NEEDLEWORK FRAME FOR HANDWORK

FIELD OF USE

The invention relates to a lightweight, portable handwork stitching aid, to be used for crafts wherein it is desirable to stitch in rows or sections onto an elevated canvas.

BACKGROUND

Rug making is an older art form that has recently been the subject of renewed interest even though the work involved is tedious and time consuming. However, the rugs produced are appealing to the observer, when various colored strands are used to form attractive designs or pictures. In recent years improved needles and hooks, the availability of a wide variety of pre-marked canvases, and the availability of pre-cut and pre-packaged yarns have helped to rekindle interest.

A number of frames and stands have been patented and marketed. Some of these devices have met with marginal commercial acceptance because of several design problems. These devices are generally heavy and bulky, do not fit onto the operator's lap, require the operator to sit upright either at a table or in a position surrounded by the device, and the devices are not readily adjustable.

It is the principal object of the subject invention to overcome the drawbacks of the prior art and to provide a canvas support apparatus that will hold securely the canvas at a height and angle that the operator can readily adjust.

Another object of the invention is to mount and elevate the canvas for use on the operator's lap at an inclined angle so that the hook or needle can easily pass through the canvas holes.

Another object of the invention is to allow for easy stitching of the first row and last row on either edge of the canvas within the frame.

Another object of the invention is to design a relatively simple and easy to use device that will securely hold the canvas during stitching, the device being lightweight and portable.

Other objects of the invention will become obvious to those persons familiar with these stitching crafts upon reading the following descriptions and specifications.

SUMMARY OF THE INVENTION

The invention as herein disclosed is a unique canvas support apparatus that is lightweight and portable and can be used on the operator's lap or on a table. The lap-sized apparatus holds the canvas in place for handwork stitching crafts, such as latch hooking and needlepoint and the like, where it is desirable to stitch in rows or sections onto an elevated canvas. The apparatus is easily adjusted so that the height and angle of the canvas can be positioned for operator comfort. The apparatus elevates the work area of the canvas for the convenience of the operator with clearance behind the work area, requiring minimum use of one of the operator's hands. This feature is important for older people with limited finger dexterity and handicapped people who have little use of one hand.

The rack is often small relative to the canvas requiring the canvas to be subdivided into sections. As each section of the canvas is completed, the canvas is relocated relative to the rack, so that a new section can be stitched. Also, several operators can work simultaneously on the same large canvas, one rack per each operator.

A number of means may be used to mount the canvas over the rack unit so that the strand is stitched into the canvas over a substantially open area in the rack unit. One method involves a plurality of upward projecting points that are a part of the rack unit along the perimeter of the inclined rack assembly. The canvas rests on the rack assembly and the points are individually fitted carefully through the holes in the canvas so as not to damage the canvas while the canvas is flat on the rack. Another mounting means involves an anchor member having a plurality of downward projecting points that pass through the canvas material and attach to the rack assembly. The anchor member rests on the canvas which rests on the rack assembly and the downward projecting points of the anchor member are individually fitted through the holes in the canvas. The points may be pins or prongs. Other mounting means may include clamps, scroll type rollers, or the like located around the edges of the rack assembly, where the canvas is securely held in place relative to the rack assembly.

The rack unit also has a base which is preferably a solid material, so that strands, needles, hooks, and the like can be kept therein. The base is substantially flat so that it can rest in a stable manner on the operator's lap or on a table. The underside of the base can be rough or coated with a tacky material so that it will not slip and slide when resting on the operator's lap.

The base and the rack assembly can be of single piece construction or the pieces can be separately made so that they fit together. The base is preferably made of a plastic material similar to dish drainer bases, but can also be made of wood, metal, plexiglass or similar materials. The rack assembly is preferably made from rubber coated metal, or molded plastic but can also be made from wood, metal or the like.

When not in use the rack unit is collapsible, conveniently fitting into the base tray with the anchor members, strands, hooks, needles, canvas for easy storage.

DETAILED DESCRIPTION

All four drawings depict the same preferred embodiment; that is, a combination rack unit that has two separate work areas and two separated mounting means.

Figures 1, 1A:
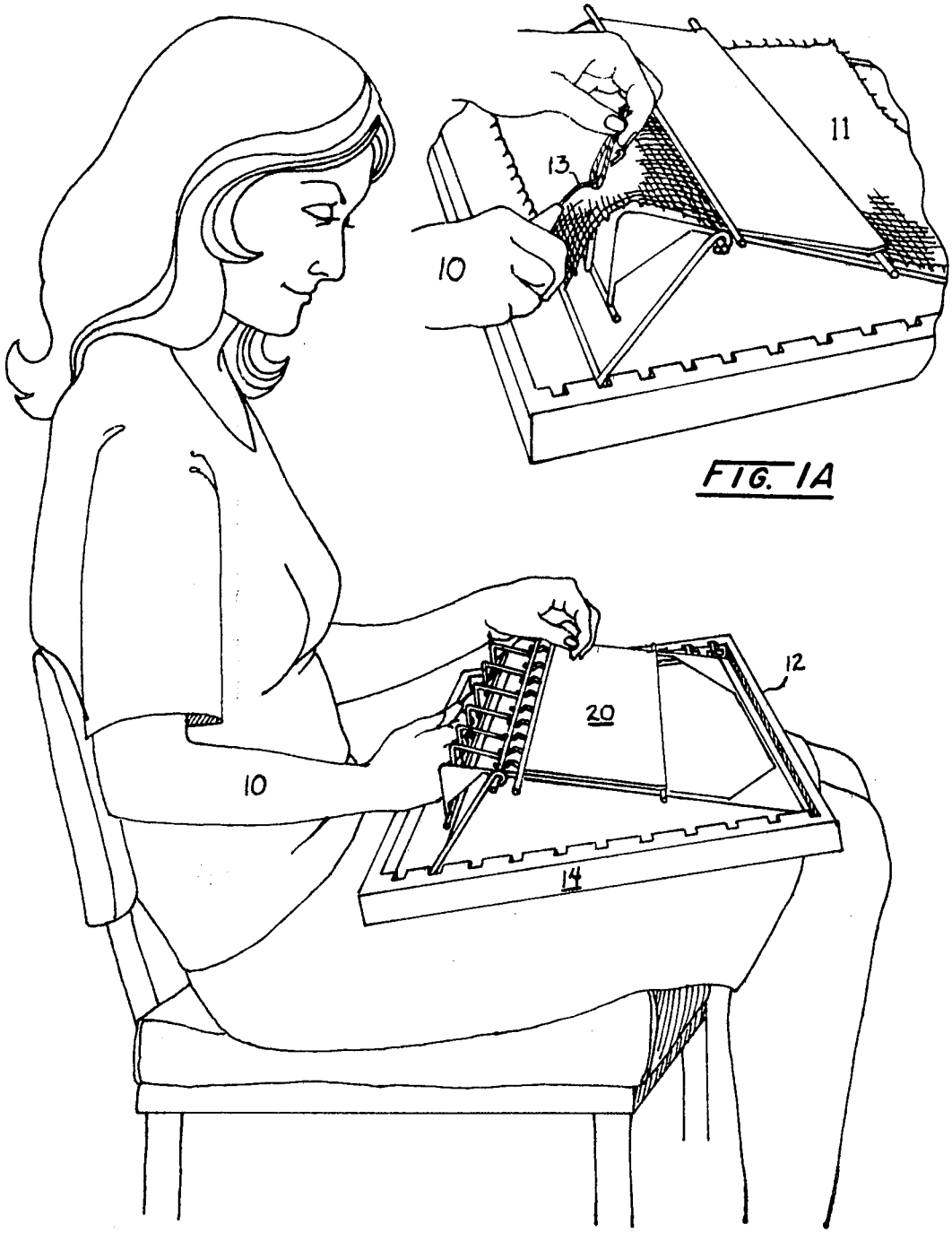
FIG. 1 is a perspective view of an operator demonstrating the apparatus for latch hooking and similar stitches, and includes Detail "A" which depicts the canvas fitting onto the apparatus.
Figures 2, 2A, 2B:
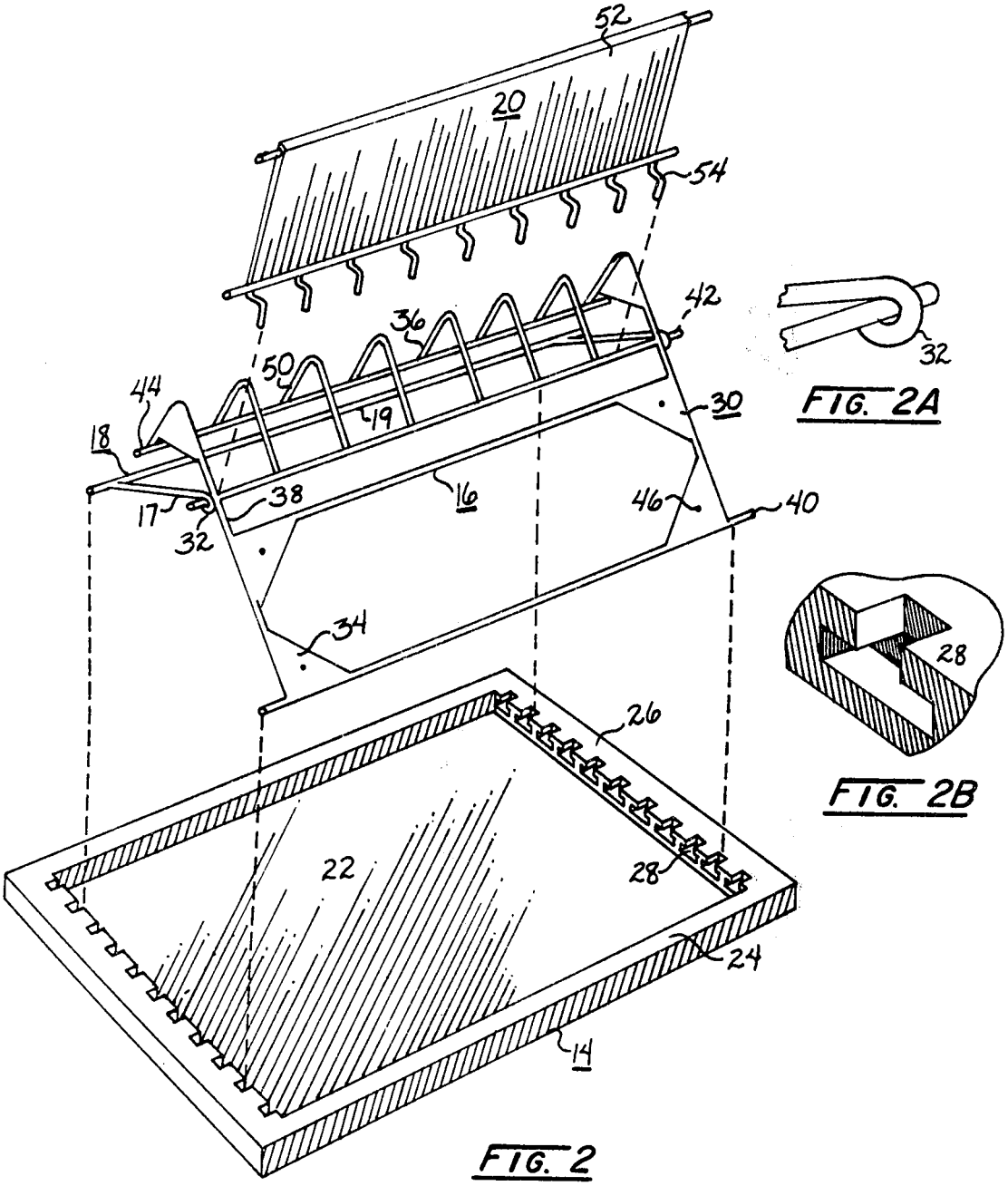
FIG. 2 is an assembly of the apparatus as used in latch hooking (same position as FIG. 1), including isometric views of the base, the frame portion, and the pronged anchor. The drawing also includes Detail "B" of the hinge, the Detail "C" of the base groove.
Figures 3, 3A:
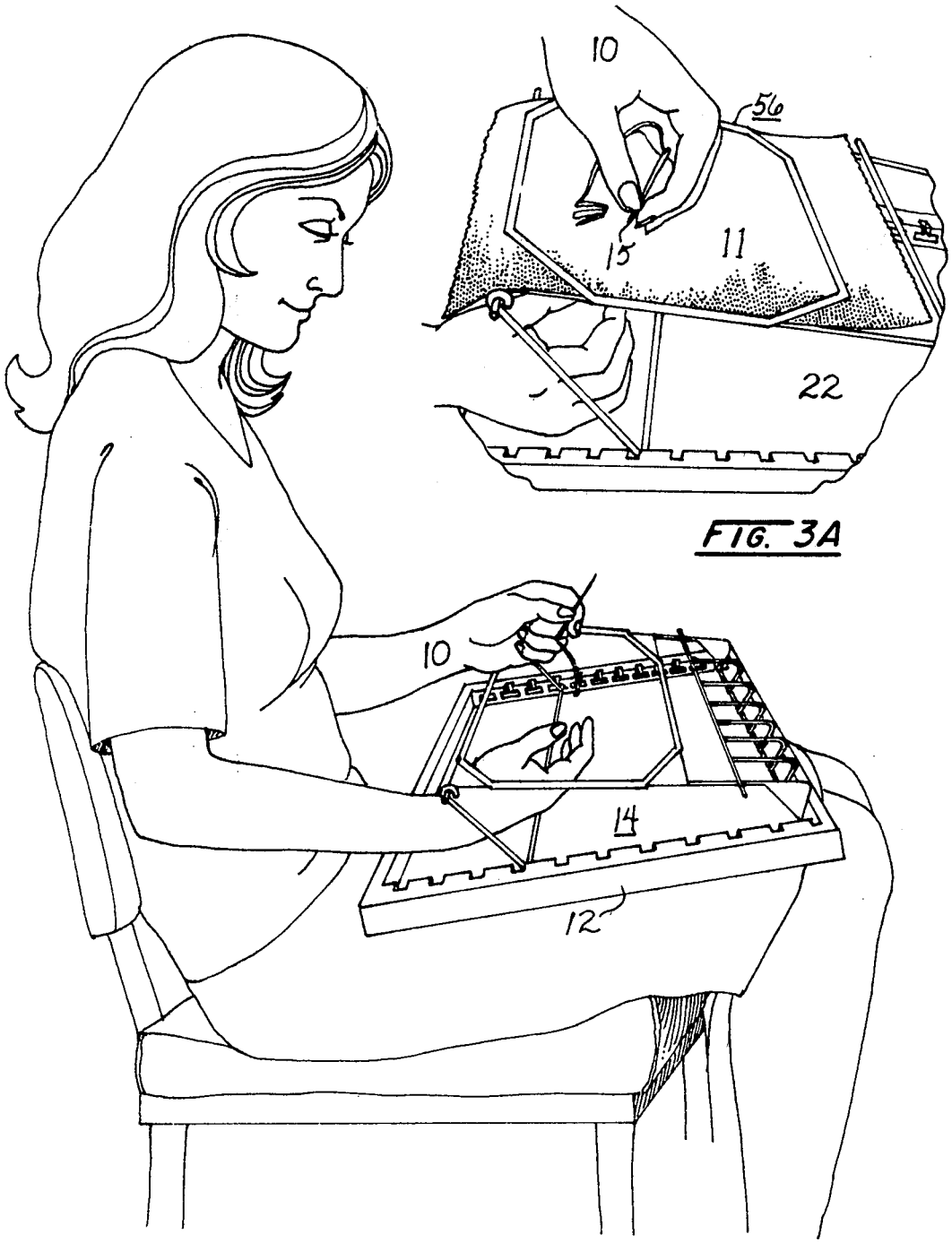
FIG. 3 is a perspective view of an operator demonstrating the apparatus for needlepoint, and similar stitches and includes Detail "D" which depicts the canvas fitting onto the apparatus.
Figure 4:
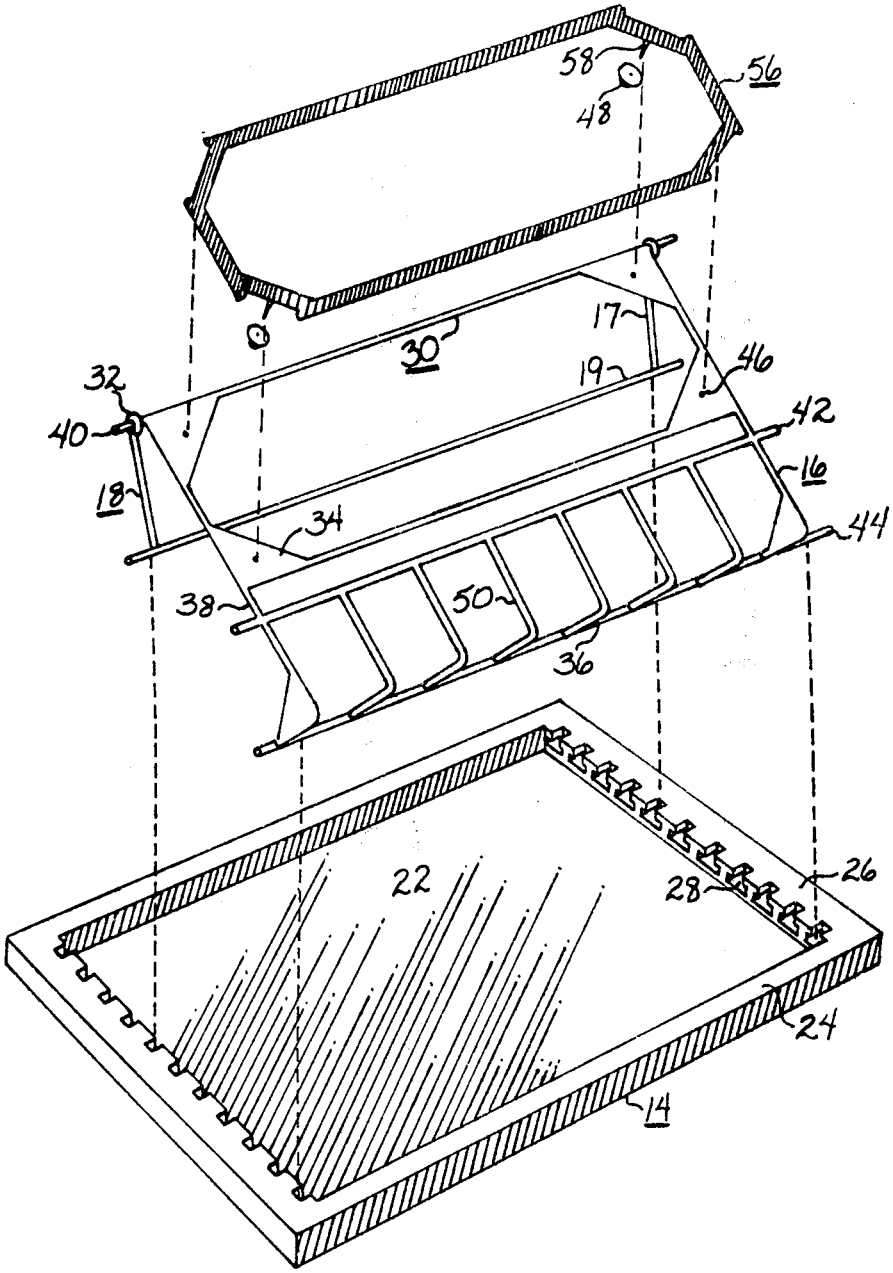
FIG. 4 is an assembly of the apparatus as used in needlepoint (same position as FIG. 3), including isometric views of the base, the frame portion, and the frame anchor.

FIG. 1 and FIG. 2 show the apparatus as it is used for latch hooking whereas FIG. 3 and FIG. 4 show the apparatus as it is used for needlepoint. The combination rack unit is considered to be the preferred embodiment since the apparatus can be used for both needlepoint and latch hooking, two types of stitching that are completely different from each other.

The position shown in FIG. 3 and FIG. 4 can be used for latch hooking but does not work as well for latch hooking as the FIG. 1 and FIG. 2 position. The position shown in FIG. 3 and FIG. 4 can also be used with a burlap canvas to make hooked rugs with hand hooks or punch needles, but to avoid confusion in this specification, the FIG. 3 and FIG. 4 position of the subject invention will be referred to as the needlepoint position.

The latch hook drawings (FIG. 1 and FIG. 2) differ from the needlepoint drawings (FIG. 3 and FIG. 4) in two ways: first, a completely different anchor is used, and second, the frame portion 30 must be inverted.

For latch hooking (FIG. 1 and FIG. 2) a canvas 11 is mounted securely over the apparatus, the apparatus having an inverted "V" section 36 which is substantially open and is the work area for latch hooking. The work area is elevated relative to a base 14. An operator 10 inserts a latch hook 13 holding the strand through the canvas 11 over the open area and then pulls the strand ends to tighten a knot about the canvas. The same reference numbers show the same parts in all drawings.

For needlepoint (FIG. 3 and FIG. 4) the canvas 11 is mounted securely and stretched over the apparatus, the apparatus having an open area inside an octagon frame 34 which is the work area for needlepoint. The work area is also elevated relative to the base 14.

It is not necessary for the subject invention to be a combination rack unit as shown in these drawings. It would be relatively easy to design a frame portion for either latch hooking or needlepoint using the principles of this disclosure that will fit securely into the base 14 and be adjustable.

FIG. 1 illustrates a preferred embodiment of the subject invention as it is used for latch hook type stitching onto a canvas.

The operator 10 is seated in an upright position with a rack unit 12 (the subject invention) resting comfortably on her lap. The rack unit 12 consists of a flat, rectangular base 14; an elevated inclined rack support 16, a rack leg 18 and a pronged anchor 20. These four components operate together to securely mount the canvas 11 (as shown in Detail "A" of FIG. 1) and hold it in place relative to the rack unit 12. The canvas 11 rests on the rack unit 12, the canvas 11 being held in place by the pronged anchor 20, which fits through the holes in the canvas 11 and attaches to the rack support 16.

The frame portion 30 is bent downward at the latch hooking work area, where it supports the canvas 11. The operator 10 uses a latch hook 13 containing one piece of strand (not shown). The operator 10 places a looped strand on the latch hook 13, and inserts the hook 13 into the aligned two holes in the canvas 11 from above the canvas 11, and by means of the hook 13 she pulls the strand ends through the holes and pulls down the sufficient pressure to knot the strand into the canvas 11.

FIG. 2 is an assembly drawing of the rack unit 12 in the latch hook mode, as shown in FIG. 1. The drawing depicts individual isometric views of the base 14, the frame portion 30, and the pronged anchor 20, with dashed lines indicating how these components fit together.

The base 14 is lap-sized, having a rectangular shape and a recessed, flat bottom 22. The underside (not shown) of the base 14 has either a rough surface, or is coated with a tacky substance to prevent slipping and sliding. The base 14 has a raised frame 24 that surrounds the bottom 22, together forming a convenient place for storing racks, anchors, hooks, needles, strands, and canvas when not in use. Two opposed sides of the raised frame 24 are grooved frame sections 26, having a plurality of inverted "T" shaped grooves 28 therein that do not extend to the recessed bottom 22 (see Detail "B" in FIG. 2). These grooves 28 allow the frame portion 30 to be adjustable, being able to be mounted in any one of several positions so that the height and angle of the work area easily adjusts for operator convenience.

The frame portion 30 consists of a rack support 16 and a rack leg 18 which are connected together by two rounded leg hinges 32 (see Detail "C" in FIG. 2) each being located at the end of each rack leg 18. The rack leg 18 consists of two identical, and parallel hinge bars 17, each having one rounded end that serves as the leg hinge 32. The leg hinges 32 are connected together at the ends opposite the hinges 32, by a leg bar 19 that protrudes beyond the two hinge bars 17, the protrusions fitting into the grooves 28 of the base 14.

The rack support 16 is an irregularly shaped, flat piece, the end section of which is bent at a right angle. One end of the rack support 16 is an inverted "V" section 36 that is used for latch hooking. The other end of the rack support 16 is an octagon frame 34 used for needlepoint. The section 36 and the frame 34 are joined by two parallel connecting rods 38 that each form part of the outline of the rack support 16.

There are three identical, parallel rods that run across the width of the rack support 16, which are perpendicular to the connecting rods 38, and are mounted onto the rack support 16 so as to protrude equally at both ends. The protrusions of these rods connect to the base grooves 28 and to the leg hinges 32 so that the rack unit 12 can be easily disassembled and reassembled by the operator 10. The octagon rod 40 is located at one extreme of the rack support 16, forming one end of the octagon frame 34. The middle rod 42 is located within the body of the rack support 16, forming one end of the latch hook work area. The end rod 44 is located at the other extreme of the rack support 16, forming the other end of the latch hook work area.

When the frame portion 30 is used for latch hooking, the octagon rod 40 of the rack support 16 fits into two opposed grooves 28 of the base 14, whereas the middle rod 42 is mounted inside the leg hinges 32 of the hinge bar 17. The leg hinges 32 can be mounted onto the end rod 44 to allow more adjustability of the height and angle of the work area. The inverted "V" section 36 is elevated relative to the base 14 and is the most remote part of the rack unit 12 from the base 14. A plurality of parallel inverted "V" rods 50 fit between and are perpendicular to the middle rod 42 and the end rod 44, and together form the inverted "V" section 36, which is the work area for latch hooking the canvas 11. The pronged anchor 20 is used in the latch hooking mode to secure the canvas 11 to the rack unit 12, although a plurality of upward projecting pins mounted along the perimeter of the rack support 16 could also be used. The pronged anchor 20 has a curved anchor body 52, which can serve as a convenient place to rest the latch hook 13 while the operator 10 is resting. The pronged anchor 20 has a plurality of identical curved prongs 54 which are used to fit through the holes in the canvas as the anchor 20 rests on the canvas 11 which rests on the rack unit 12.

The prongs 54 fit under and around the middle rod 42 to hold the sandwiched canvas 11 securely in place. For latch hooking, it is not necessary to hold the canvas 11 taut or stretched, but rather it is only necessary to hold the canvas secure in place relative to the rack unit 12, as the operator tightens strand knots.

FIG. 3 illustrates the preferred embodiment of the subject invention as it is to be used for needlepoint.

The operator 10 is seated in an upright position with the inverted rack unit 12 on her lap. The rack unit 12, as used in this position, consists of the base 14, the inverted rack support 16, a rack leg 18, and a frame anchor 56. To convert the rack unit 12 into this position from the position shown in FIG. 1 and FIG. 2, the pronged anchor 20 and the canvas 11 are removed, frame portion 30 is removed from the base 14, and the rack leg 18 is removed from the rack support 16. The rack leg 18 is reattached to the rack support 16, along both ends of the octagon rod 40. The end rod 44 and the leg bar 19 are each inserted into two grooves 28 of the base. To allow for more adjustability of the height and angle of the work area for needlepoint, the leg bar 19 can be doubled back and form an obtuse angle with the plane of the base as it fits into two grooves 28 or it can form an acute angle with the plane of the base.

FIG. 4 is an assembly drawing of the rack unit 12 in the needlepoint mode, as shown in FIG. 3. The drawing depicts individual isometric views of the base 14, the frame portion 30 and the frame anchor 56 with dashed lines indicating how these components fit together. The work area for needlepoint is the opening inside the octagon frame 34, which is elevated relative to the base 14 and may be inclined relative to the base 14 (See Detail "D" in FIG. 3). The octagon frame 34 is used to hold the canvas 11 secure relative to the rack unit 12. It is important in needlepoint work that the canvas 11 be held taut and stretched during stitching, which is the reason for having two separate work areas on the rack unit. The operator 10 attaches the strand to a needle 15 used in needlepoint, the needle 15 and strand are then placed through the top of a hole in the stretched canvas 11 and reinserted through the bottom of an adjacent hole (see Detail "D") as mounting means to hold the canvas 11 onto the rack unit 12 a plurality of upward projecting pins mounted around the perimeter of the frame portion 30 could again be used. However, the drawings show a frame anchor 56 which rests on the canvas 11 that rests on the rack unit 12, the anchor 56 having four downward projecting pins 58 that fit through holes in the stretched canvas 11, into four pin holes 46 in the octagon frame 34, being held in place by pin tacks 48, one for each frame pin 58. The frame anchor 56 fastens at an angle across each corner to hold the canvas 11 without distorting the canvas corners.

For storage, the rack unit 12 is disassembled into its individual components which are folded up and stored in the base 14 along with the canvas 11, strands, needles 15, latch hooks 13 and other related materials.

Although the present invention has been specifically disclosed with preferred embodiments, many other forms of the invention are possible. It is not intended herein to mention all possible forms of the invention and the terms used are descriptive rather than limiting. Accordingly, the scope of this invention is intended to be limited only by the scope of the appended claims.

I claim:

1. An apparatus to support a canvas as a strand is stitched into the canvas, which comprises:

a lap-sized rack unit having a substantially flat base, and a frame portion that is inclined relative to the base, the top part of the frame portion being bent downward toward the base, the side profile of the inclined frame portion, the downward bend portion, and the base being in the general shape of a triangle, the frame portion having a substantially open area therein located at the top of the frame portion; and means for securely mounting the canvas over the rack unit so that the strand can be stitched into the canvas over the substantially open area while the rack unit holds the canvas in place.

2. A canvas support apparatus as recited in claim 1 in which the elevation of the frame portion is adjustable relative to the base.

3. A canvas support apparatus as recited in claim 2 in which the base has a plurality of grooves to adjust the elevation of the frame portion relative to the base.

4. A canvas support apparatus as recited in claim 1 in which the mounting means is a plurality of upwardly projecting pins in the frame portion.

5. A canvas support apparatus as recited in claim 1 in which the mounting means is an anchor that rests over the canvas with a plurality of downward projecting points that pass through the canvas and attach to the frame portion.

6. A canvas support apparatus as recited in claim 1 in which the side profile of the frame substantially comprises an inverted V.

* * * * *